US005401925A

United States Patent [19]

Sambar

[11] Patent Number: 5,401,925

[45] Date of Patent: Mar. 28, 1995

[54] ELECTRICAL SWITCH WITH REMOVABLE OPERATOR

[75] Inventor: Homer S. Sambar, Milwaukee County, Wis.

[73] Assignee: Allen-Bradley Company, Inc., Milwaukee, Wis.

[21] Appl. No.: 146,366

[22] Filed: Oct. 29, 1993

[51] Int. Cl.[6] ..... H01H 9/08

[52] U.S. Cl. ..... 200/296

[58] Field of Search ..... 200/296, 295, 345

[56] References Cited

U.S. PATENT DOCUMENTS 4,250,368 2/1981 Johnston et al. ..... 200/296 X
4,533,804 8/1985 Kramer ..... 200/345
5,178,504 1/1993 Falchi ..... 200/296 X

*Primary Examiner*—Renee S. Luebke

*Attorney, Agent, or Firm*—John Horn; H. F. Hamann

[57] ABSTRACT

A latch for connecting a switch operator, such as a push button, to contact blocks in an industrial switch employs opposed spring loaded teeth to engage detent surfaces on the operator. The teeth are attached to jaws generally along a line parallel to the line between the opposed teeth but to one side of a sleeve receiving the operator. The jaws and teeth are connected so that separation of the jaws separate the teeth allowing disengagement of the operator. The space between the jaws is accessible along an axis extending toward the back of the switch so as to permit release of the operator by means of a tool such as a screwdriver without clearance about the switch. The teeth may be wedge shaped to permit the operator to snap in place, only, without the use of the tool.

9 Claims, 2 Drawing Sheets

ELECTRICAL SWITCH WITH REMOVABLE OPERATOR

FIELD OF THE INVENTION

The field of the invention is industrial electrical switches and in particular switches suitable for mounting on a panel or the like.

BACKGROUND ART

Electrical switches such as pushbutton or rotary switches used for the control of industrial equipment are typically mounted on a front panel of a cabinet so that the manipulated portion of the switch (termed the "operator") projects out from and is accessible at the front of the cabinet, but the contacts of the switch and wiring to the contacts is protected within the cabinet.

For a single piece pushbutton switch, a hole may be punched in the cabinet of sufficient diameter to accommodate the pushbutton and a surrounding threaded flange. The flange and pushbutton are inserted through the cabinet from the inside and a threaded retaining nut is placed over the flange on the outside of the cabinet and tightened on the flange to securely affix the switch to the panel. The panel is thus sandwiched between the switch body and the retaining nut. For rotary switches, the operator lever may be designed to be smaller than the hole in the panel, so as to fit through the hole, or may be detachable from the operator.

A multi-piece pushbutton switch, conforming to the international "IEC standard", has an operator which may be separated from its contact blocks and installed through the front of the panel. Only the shaft of the operator extends through the panel and hence there is no size limit on the size of the actual pushbutton imposed by the hole. For example, the hole in the panel is typically only 22.5 mm and yet permits the use, for example, of an operator with an integral 40 mm mushroom pushbutton head.

Typically the detachable operator, terminating in a flange surrounding the pushbutton or lever, is inserted through a hole in the panel and secured from behind the panel with a nut so that the panel is held between the nut and the flange. The end of the operator protruding inside of the panel is snapped into one side of a latch element. Various contact blocks, depending on the particular configuration desired, are snapped onto the other side of the latch.

In order to facilitate connecting the necessary wires to the contact blocks, the latch and contact blocks may be unsnapped from the operator by pulling the latch away from the operator. Once the necessary wires are connected to the contact blocks, the latch and contact blocks may be reattached by snapping to the operator. The snap fastening is obtained by the use of detents on the latch which engage corresponding detent surfaces on the operator assembly. Such a fastening technique permits the switches to be placed closely together because no clearance around the switch is required for the assembly of the operator to the contact blocks.

Although this snap fastening approach is extremely flexible and convenient, the physical mounting of the switch elements to the panel is not as robust as the one piece switch described previously where the operator is permanently affixed to the contact blocks.

SUMMARY OF THE INVENTION

The present invention provides a more robust latch for connecting an operator to contact blocks that permits snap-type connection but that prevents an unsnapping without the use of a tool.

Specifically, the latch used to connect the contact block to the operator has a sleeve sized to receive a first end of the operator along an operator axis. A first and second spring-loaded tooth extend into the sleeve from opposite sides of the sleeve along a tooth axis. Displaced to the side of the sleeve and separated along an axis substantially parallel to the tooth axis are a first and second jaw. The jaws define a space that is accessible by a tool inserted along a tool axis. Tie rods attach the first jaw to the first tooth and the second jaw to the second tooth so that increased separation of the jaws increases the separation of the teeth. The jaws may be separated, to a separation distance, by means of a wedge shaped tool inserted into the space between the jaws to cause the teeth to move apart to permit removal of the operator.

It is just a first object of the invention, therefore, to provide a means of increasing the security with which the operator is attached to the contact blocks with a mechanism that may be simply incorporated into a latch between the contact blocks and operator. A tool is required only to separate the latch from the operator.

The required separation distance may be equal to the diameter of a No. 1 Phillips screwdriver commonly carried by electricians. The housing of the latch may provide a pair of opposed edges of a supporting channel separated by the predetermined distance that the jaws must be opened to release the operator.

Thus, it is another object of the invention to provide the security of a locking latch without the inconvenience of needing a specialty tool and to provide a clear guide to the electrician as to the size of the tool needed to release the operator and to prevent the possible use of oversized tools that might damage the latch. Another object of the invention is to permit single-handed release of the latch from the operator, as is particularly important when there is little clearance around the switches. The jaws and channel further serve to retain the tool without the tool slipping from position or the jaws closing even if the tool is not being held in place.

The teeth may have a ramped surface so that action of inserting the operator into the latch opens the teeth apart without the need to separate the jaws with a tool. This allows a snap fitting together of the operator and latch and yet resist a snap removal of the operator from the latch without the tool. Further, the tool axis, along which the tool is inserted, may be aligned with the operator axis.

Thus, it is another object of the invention to provide a latch with positive locking action without sacrificing the ability to closely space the switches on a panel that may be obtained with prior art snap-type latches. Even if switches are placed to abut their neighbors, the latch may be released.

The foregoing and other objects and advantages of the invention will appear from the following description. In the description, reference is made to the accompanying drawings which form a part hereof and in which there is shown by way of illustration, a preferred embodiment of the invention. Such embodiment does not necessarily represent the full scope of the invention, however, and reference must be made therefore to the claims herein for interpreting the scope of the invention.

BRIEF DESCRIPTION OF THE DRAWINGS

FIG. 2(*b*) is a figure similar to FIG. 2(*a*) showing the insertion of a screwdriver between jaws of the latch to move the teeth to an open unlatching position to allow unobstructed removal or insertion of the operator.

DETAILED DESCRIPTION OF THE PREFERRED DESCRIPTION

Figure 1:
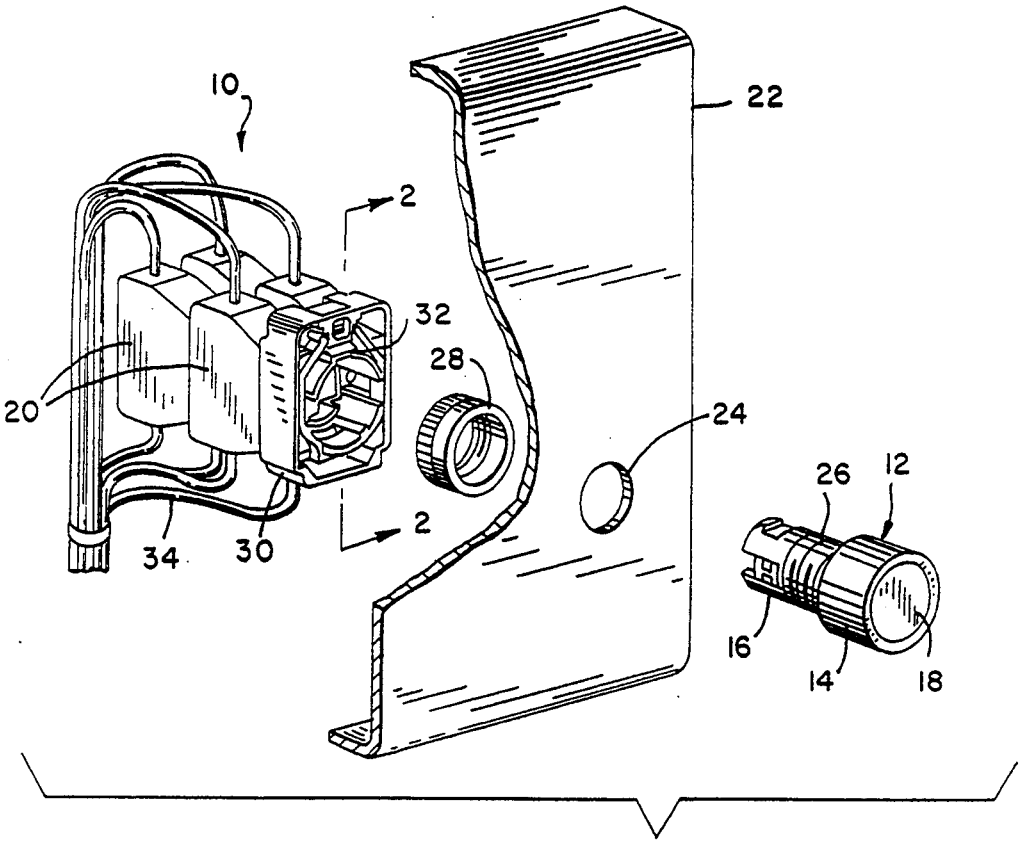
FIG. 1 is a perspective view in cutaway of a cabinet on which switches may be mounted, showing insertion of an operator assembly through a hole in the cabinet to be secured by a nut and attached to a latch of the present invention, the latter holding a set of contact blocks.

Referring to FIG. 1, a switch 10 includes an operator assembly 12 having a head 14 at one end of a cylindrical shaft 16. The head 14 may include a pushbutton 18 or other such manually operated portion such as a lever (not shown). The pushbutton 18 attaches to a stem 19 (shown in FIG. 2(*a*)) passing inside the shaft 16 to communicate the action of the pushbutton 18 to a set of contact blocks 20. The stem 19 of the pushbutton 18 is biased outward by a spring 38 which may be custom tailored to the particular type of operator being employed.

Figure 2A:
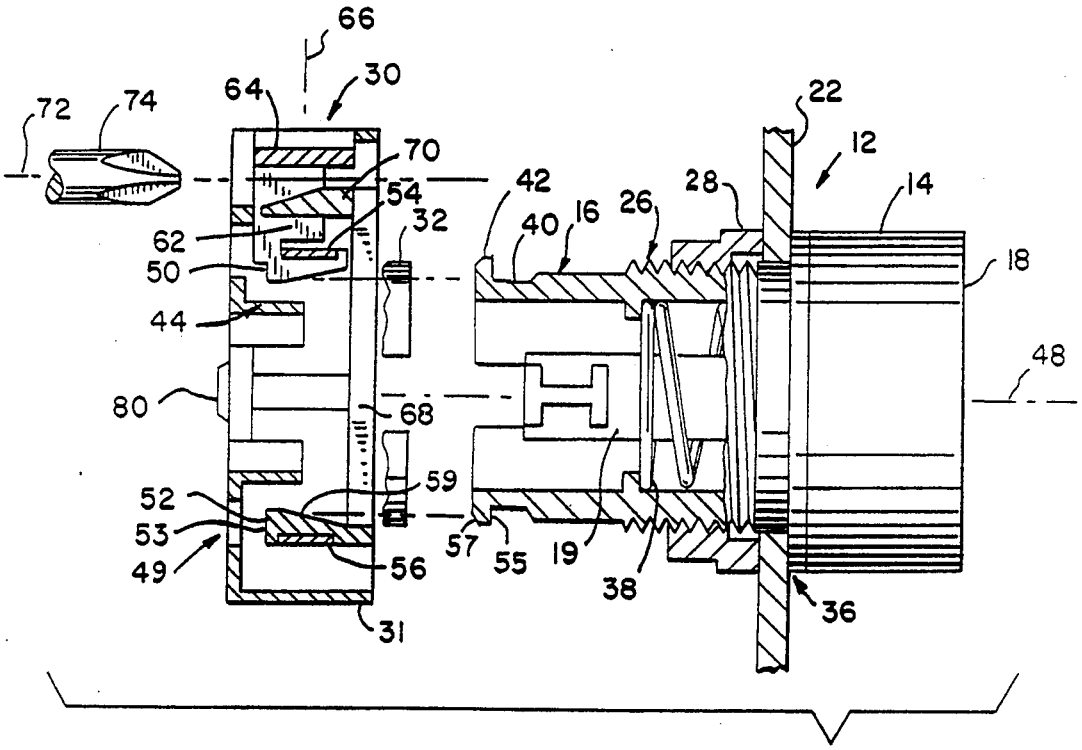
FIG. 2(*a*) is a cross-section along line 2—2 of FIG. 1 showing the latch of the present invention next to an uninserted operator with teeth of the latch in a closed latching position.
Figure 2B:
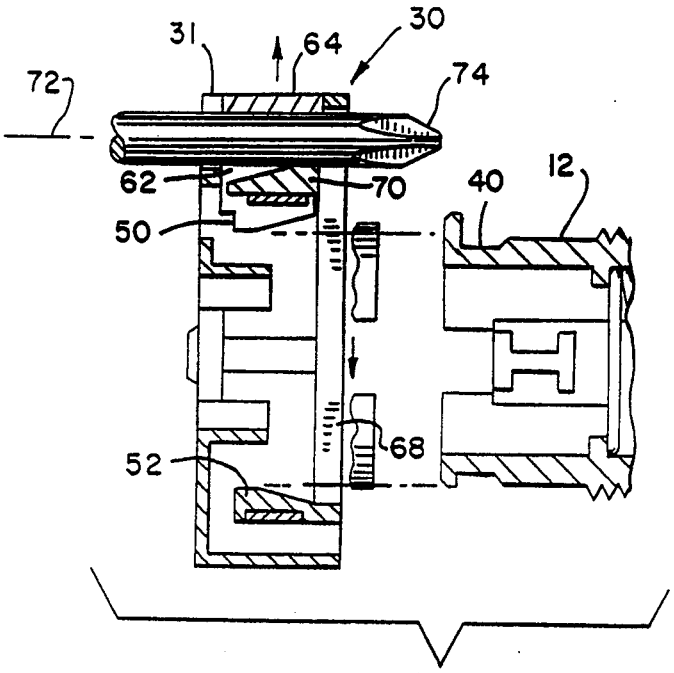

Referring still to FIG. 1, a sheet metal panel 22 has a hole 24 (22.5 mm per IEC standard) for receiving the shaft 16 of the operator assembly 12. Threads 26 are cut in the portion of the shaft 16 passing through the hole 24. The head 14, remaining on the outside of a panel 22 when the shaft 16 is inserted into the hole 24, is drawn against the panel 22 by a nut 28, placed over the shaft 16 inside of the panel 22 and tightened on the threads 26. The panel 22 is thus sandwiched between nut 28 and an inner face of the head 14. Referring to FIG. 2(*a*), an elastomeric washer 36 positioned between the head 14 and the panel 22 on the outside of the panel 22 provides a seal against the outside environment.

The portion of the shaft 16 displaced from the head 14, and passing through the panel 22, is received by a latch 30 having a generally cylindrical sleeve 32 in its front face. The rear face of the latch 30 may be attached to one or more contact blocks 20 which may be prewired to a harness 34. The back wall of the latch 30 includes threaded bosses 80 which are used to attach the contact blocks 20 to the latch 30 with machine screws (not shown).

Referring now to FIGS. 2(*a*) and 2(*b*), the inner end of the shaft 16 includes a circumferential groove 40 used for retaining the operator assembly 12 within the latch 30. A key 42 fits within a key way 44 in sleeve 32 to prevent rotation of the operator assembly 12 with respect to the latch 30 and which prevents the operator assembly 12 from being inserted up-side-down for operator assemblies that have an up and down sense.

The operator assembly 12 is received by the latch 30 along axis 48, sliding into the sleeve 32 and abutting the rear wall 49 of the latch 30. When the operator assembly 12 is so seated, grooves 40 are engaged by an upper tooth 50 and a lower tooth 52 extending inward from opposite sides of the sleeve 32.

An upper leaf spring 54 is positioned to fit across a top surface of the tooth 50 urging the tooth 50 into the sleeve 32. The upper leaf spring 54 extends laterally across the latch 30 and is supported at its ends by flanges 58 (shown in FIG. 3) formed within the side housing 31 of the latch 30.

Likewise, a lower leaf spring 56 is carried by flanges 60 in the side walls of the side housing 31 of the latch 30 so as to press upward on the lower surface of tooth 52 urging tooth 52 into the sleeve 32.

When the operator assembly 12 is seated within the sleeve 32, the teeth 50 and 52 engage the groove 40 so that a rearward face 53 of the teeth 50 and 52 abuts a substantially parallel rear wall 55 of the groove 40. Both the face 53 and wall 55 are substantially perpendicular to the insertion axis 48 of the operator assembly 12 so that any force on the operator assembly 12 along axis 48 in the direction of disengaging the operator assembly 12 from the latch 30 does not move the teeth 50 and 52 from their engaged position.

Conversely, when the operator assembly 12 is being inserted into the sleeve 32, a wedge shaped surface 57 of the leading edge of the shaft 16 rides along a wedge shaped surface 59 of the teeth 50 and 52 so that their interface is along the insertion axis 48 to have progressively greater separation as one moves away from the rear wall 49 of the latch 30. Insertion of the operator assembly 12 thus can move the teeth 50 and 52 outward against the force of springs 54 and 56 to permit passage of the operator assembly 12 fully into the sleeve 32 until the teeth 50 and 52 fall into the groove 40.

Thus, the operator assembly 12 may be snapped into place by force along axis 48 but may not be disengaged simply by force in the opposite direction.

The upper tooth 50 is attached by a tie rod 62 to an upper jaw 64 positioned above teeth 50 and 52 but generally in line with an imaginary tooth axis 66 passing through the center of teeth 50 and 52. Lower tooth 52 is connected by tie rod 68 to a lower jaw 70 also positioned along the tooth axis 66 beneath the jaw 64 and between the jaw 64 and tooth 50. Tie rod 68 is preferably a ring surrounding the sleeve 32 so as to provide increased strength in a thin member.

Alignment of the teeth 50 and 52 with the jaws 64 provides that movement of the jaws 64 and 70 in separation causes a corresponding motion of the teeth 50 and 54 without torsion, permitting the tie rods 62 and 68 to be only loosely guided by the housing of the latch 30 significantly reducing friction and providing a far more compact mechanism than might be obtained if more elaborate linkages or guides were used.

When teeth 50 and 52 fully project into the sleeve 32 and engage the groove 40 of the operator assembly 12, the jaws 64 and 70 define between them a space having a separation distance less than approximately 4.5 mm. Referring to FIG. 2(*b*), to release the operator assembly 12 from the latch 30, a No. 1 Phillips head screwdriver 74 inserted into the space between the jaws 64 and 70 which forces the jaws 64 and 70 apart to a distance of approximately 4.5 mm causing an equal separation in the teeth 50 and 52. This moves teeth 50 and 52 out of groove 40.

When the teeth 50 and 52 are fully disengaged with the groove 40 of the operator assembly 12, the upper surface of jaw 64 moves to a position flush with the outer housing 31 of the latch 30 providing a visual indication of the release of the operator assembly, and during insertion of the operator assembly 12, providing a visual indication that the operator assembly 12 is not fully engaged with the latch 30.

The space between jaws 64 and 70 is accessible along a tool axis 72 through the housing 31 of the latch 30, the tool axis 72 being parallel to the insertion axis 48. To aid in the insertion of the tool 74, the upper surface of the contact blocks 20 also form a trough 21 along axis 72.

Figure 3:
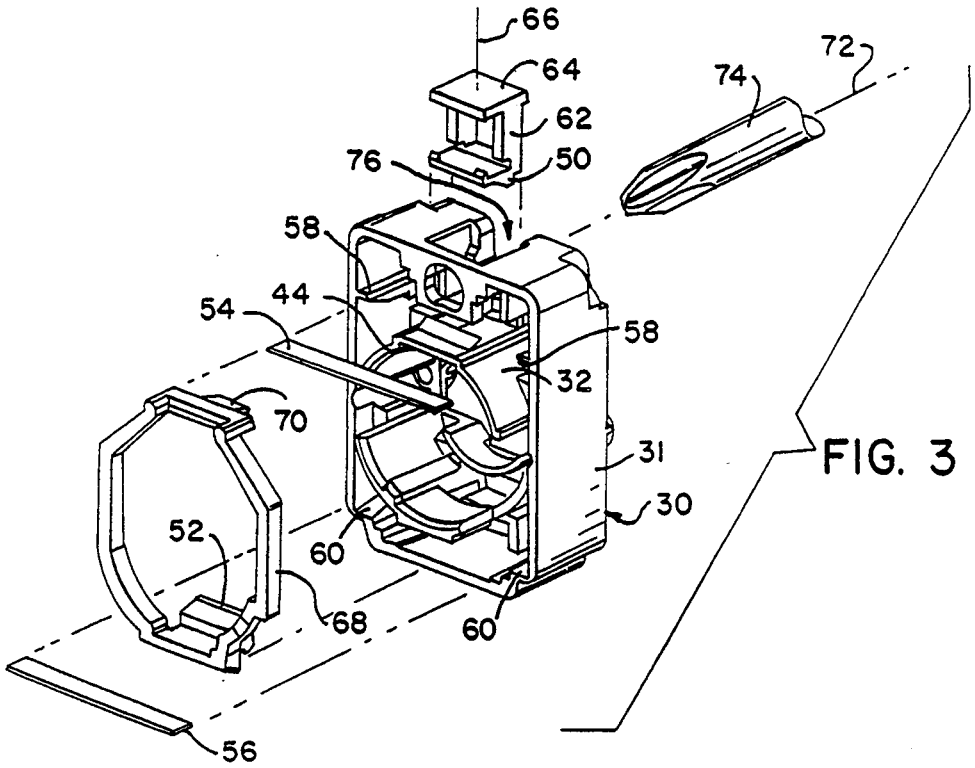
FIG. 3 is an exploded perspective of the latch of FIGS. 2(*a*) and 2(*b*) showing the opposed teeth used for engaging the operator and the insertion angle of a Phillips head screwdriver for disengaging the operator.

Referring to FIG. 3, the housing 31 of the latch 30 at the point of insertion of the Phillips head screwdriver 74 incorporates a channel 76 having a width equal to the separation distance of the jaw 64 from the jaw 70 needed for release of the operator assembly 12. The channel 76 thus provides a guide to the required size of tool 74 necessary for the release of the operator assembly 12 and prevents the insertion of tools 74 of too great of a diameter. The channel 76 combined with the spring operation of the jaws 64 and 70 serves to support the tool 74 in place, holding the teeth 50 and 52 open, so that the latch 30 may be removed with a single hand first inserting the tool 74 then releasing the tool 74 to grasp the latch 30 to separate the latch 30 from the operator assembly 12.

The No. 1 Phillips head screwdriver used to release the operator assembly 12 from the latch 30 is readily available and commonly used by electricians. However, it will be understood that other tools may be used to separate the jaws 64 and 70 provided they have this proper thickness along at least one dimension.

The parts of the latch 30 may be die-cast from zinc and finished with a surface coating such as is well known in the art. The leaf springs 54 and 56 may be stainless steel.

In order to apprise the public of the various embodiments that may fall within the scope of the invention, the following claims are made.

I claim:

1. A contact block support used to attach one or more contact blocks of an electrical switch to a switch operator, the switch operator having a first end with detent surfaces, the contact block support comprising:

a sleeve sized to receive the first end of the switch operator;

a first and second tooth opposed across the sleeve along a tooth axis and spring loaded to extend into the sleeve;

a first and second jaw opposed along a jaw axis substantially parallel to the tooth axis, to one side of the sleeve, said jaws separated by a separation distance to define a space therebetween, the space being accessible to a tool inserted along a tool axis; and a first and second tie rod connecting the first jaw to the first tooth and the second jaw to the second tooth respectively, so that when the separation distance between the jaws is increased to a predetermined distance, the teeth move apart to permit free passage of the detent surfaces of the switch operator.

2. The contact block support as claimed in claim 1 wherein the first and second teeth are wedge shaped to permit the first end of the switch operator to separate the teeth as it is inserted into the sleeve but not to separate the teeth when it is withdrawn from the sleeve.

3. The contact block support as claimed in claim 1 wherein the tool axis is parallel to an axis along which the switch operator is inserted into the sleeve.

4. The contact block support as claimed in claim 1 wherein the predetermined separation distance is substantially equal to the diameter of a standard Phillips screwdriver.

5. The contact block support as claimed in claim 1 wherein the tie rod connecting the first jaw to the first tooth is a ring surrounding the sleeve.

6. The contact block support as claimed in claim 1 wherein the jaws are retained within a housing and wherein one jaw includes a portion that moves flush with an outer edge of the housing when separation distance between the jaws is increased to a predetermined distance.

7. The contact block support as claimed in claim 1 including a pair of opposed fixed edges separated by the predetermined distance and positioned along the tool axis to prevent a tool having a width greater than the predetermined distance from being inserted between the jaws.

8. The contact block support as claimed in claim 1 wherein the space between the jaws forms part of a channel that may retain and support a tool inserted into the space to separate the jaws by the predetermined distance.

9. A contact block support used to attach one or more contact blocks of an electrical switch to a switch operator, the switch operator having a first end with detent surfaces, the contact block support comprising:

a sleeve sized to receive the first end of the switch operator along an operator axis;

at least one tooth spring loaded to extend into the sleeve along a tooth axis;

at least one jaw forming part of a channel defining a space for receiving a tool along a tool axis parallel to the operator axis, the jaw mounted to move a predetermined distance along a jaw axis parallel to the tooth axis upon insertion of the tool; and at least one tie rod attaching the jaw to the tooth, so that when the jaw is moved by the tool by the predetermined distance, the tooth moves to permit free passage of the detent surfaces of the switch operator and the jaw is urged against the tool to stably hold the tool within the channel.

* * * * *